US011511450B2

(12) United States Patent
Hartmann

(10) Patent No.: US 11,511,450 B2
(45) Date of Patent: Nov. 29, 2022

(54) SLICING MACHINE WITH PRODUCT RECOGNITION DEVICE

(71) Applicant: MULTIVAC SEPP HAGGENMUELLER SE & CO. KG, Wolfertschwenden (DE)

(72) Inventor: Albert Hartmann, Dietmannsried (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 0 days.

(21) Appl. No.: 17/231,332

(22) Filed: Apr. 15, 2021

(65) Prior Publication Data

US 2021/0323186 A1 Oct. 21, 2021

(30) Foreign Application Priority Data

Apr. 16, 2020 (DE) ..... 102020110423.5

(51) Int. Cl.
*B26D 7/01* (2006.01)
*B26D 5/00* (2006.01)
(Continued)

(52) U.S. Cl.
CPC ..... *B26D 7/01* (2013.01); *B26D 5/007* (2013.01); *B26D 5/42* (2013.01); *B26D 3/161* (2013.01);
(Continued)

(58) Field of Classification Search
CPC ..... B26D 2007/011; B26D 2007/013; B26D 2210/02; B26D 3/161; B26D 5/007; B26D 5/42; B26D 7/01
(Continued)

(56) References Cited

U.S. PATENT DOCUMENTS 5,628,237 A * 5/1997 Lindee ..... B26D 7/01 83/403.1
2012/0312135 A1* 12/2012 Schaub ..... B26D 7/0608 83/72
(Continued)

FOREIGN PATENT DOCUMENTS

DE 198 11 418 A1 10/1999
DE 695 16 809 T2 10/2000
(Continued)

OTHER PUBLICATIONS

German Search Report dated Apr. 16, 2020, Application No. 10 2020 110 423.5, Applicant MULTIVAC Sepp Haggenmueller SE & Co. KG, 7 Pages.

*Primary Examiner* — Laura M Lee
(74) *Attorney, Agent, or Firm* — Brooks Kushman P.C.

(57) ABSTRACT

In order to reliably detect, without supplying electric current or any other type of energy to a gripper, whether a rear end of a product caliber is in a grippable position close to a gripper base body and/or gripper claws are extended into the product caliber, i.e., are activated, a signal transmitter may be moved into an activated position via a purely mechanical operative connection between a sensing element, which detects the approach of the product caliber to the gripper base body in a contacting manner, which position can be detected by a sensor arranged far behind the gripper at a base frame of the machine.

20 Claims, 8 Drawing Sheets

(51) Int. Cl.
*B26D 5/42* (2006.01)
*B26D 3/16* (2006.01)

(52) U.S. Cl.
CPC .. *B26D 2007/011* (2013.01); *B26D 2007/013* (2013.01); *B26D 2210/02* (2013.01)

(58) Field of Classification Search
USPC ..... 83/72, 422
See application file for complete search history.

(56) References Cited

U.S. PATENT DOCUMENTS

| | | | | |
|---|---|---|---|---|
| 2013/0074667 | A1* | 3/2013 | Weber | B25J 11/0045 83/72 |
| 2018/0186011 | A1* | 7/2018 | Pryor | B26D 5/00 |

FOREIGN PATENT DOCUMENTS

| | | | |
|---|---|---|---|
| DE | 14 13 568 | C2 | 8/2003 |
| EP | 0 713 753 | B2 | 6/2015 |
| WO | 2010/011237 | A1 | 1/2010 |
| WO | 2018/128726 | A1 | 7/2018 |

* cited by examiner

SLICING MACHINE WITH PRODUCT RECOGNITION DEVICE

CROSS-REFERENCE TO RELATED APPLICATION

This application claims priority to German Patent Application No. DE 102020110423.5 filed on Apr. 16, 2020, the disclosure of which is incorporated in its entirety by reference herein.

TECHNICAL FIELD

The invention relates to slicing machines, in particular so-called slicers, which are used in the food industry to slice strands of an only slightly compressible product such as sausage or cheese.

BACKGROUND

Since these strands can be produced with a cross-section that maintains its shape and dimensions well over its length, i.e., essentially constant, they are called product calibers.

In this process, several product calibers are usually sliced side by side at the same time by cutting off one slice at a time by the same blade, which moves in a transverse direction to the longitudinal direction of the product calibers.

The product calibers are moved forward in a feed direction from a feed conveyor in the direction of the blade, usually on an obliquely downwardly directed feed conveyor, and are each guided through the product openings of a so-called cutting frame, at the front end of which the part of the product caliber projecting beyond this is cut off as a slice by the blade directly in front of the cutting frame.

The slices usually fall onto a discharge conveyor, by means of which they are transported away for further processing.

During slicing, the product calibers are usually held at their rear end facing away from the blade by a gripper which is provided, for example, with corresponding adjustable gripper claws which can be forwarded into the caliber, in particular transversely to the feed direction. In order to be able to grip a product caliber, such a gripper first approaches this end of the product caliber with its claws open, i.e., in its release position, in particular until it comes into contact with the base body of the gripper, and then changes to an engagement position in which the claws of the gripper engage in the product caliber in order to hold it securely.

Since the product calibers to be sliced by a generic slicing machine can have different lengths, a product detection device is usually provided which is capable of detecting whether the gripper has reached and, in particular, gripped the corresponding product caliber.

In the prior art, product detection devices have already been proposed in which it is determined whether or not the gripper has reached the product caliber at the basis of a drive torque acting on a drive device driving the gripper.

However, this detection measure proves to be disadvantageous in particular if a plurality of essentially parallel grippers are provided for parallel product calibers that are only driven together, since the drive device reaches the specified drive torque even if, for example, there is only one product caliber at only one gripper. This single product caliber is then compressed with the force resulting from the drive torque, which would otherwise be distributed among the corresponding plurality of product calibers.

As a result, with such a product detection device, it is not possible to distinguish whether or not there is a product caliber at each gripper.

Alternatively, product recognition devices are known which can be used to determine separately for each gripper whether a product caliber is present there or not. However, these known systems use electrically operated, contact-sensitive or contactless sensors provided on the gripper itself, which can, however, be susceptible to malfunctions when contamination regularly occurs on the grippers and in the slicing area of the machine and cleaning measures therefore have to be carried out there.

SUMMARY

It is therefore the object of the invention to provide a slicing machine, in particular a slicer, which has a precise and at the same time robust and process-reliable product detection device for detecting a product caliber at a gripper.

A slicing machine of the type, in particular a slicer for slicing product calibers of sausage or cheese, typically comprises on the one hand a cutting unit, usually with a rotating, plate-shaped blade, usually a sickle-shaped blade, and on the other hand a feed unit for feeding the one or more product calibers to be sliced simultaneously to the cutting unit in a feed direction.

Furthermore, a gripper is provided for each product caliber, which holds the rear end of the product caliber facing away from the cutting unit and can be moved together with it in the feed direction. The gripper elements, usually gripper claws, of the gripper are adjustable between a release position, in which it does not hold any product caliber, and an engagement position, in which the gripper holds the product caliber, usually by the gripper claws being in the product caliber.

Such a machine naturally also includes a control system for controlling at least all moving parts of the slicing machine.

The basic idea of the present invention is to provide a product detection device that does not require electrical, electronic or pneumatic systems in the contamination-intensive area on the gripper.

For this purpose, a mechanical sensing element is provided, which is movably arranged at the gripper and is moved by the product caliber when it is close enough to the gripper, in particular when the gripper elements of the gripper are additionally in the engaged position.

This sensing element is coupled without electrics, preferably mechanically, to a signal transmitter which is also movable and assumes an activated position as a switching flag when the sensing element is in the first position activated by a product caliber.

Preferably, the sensing element can be extended from the base body of the gripper, in particular in the feed direction, and is displaced relative to the gripper by a rear end of a product caliber which approaches and, in particular, ultimately abuts the base body. This is a particularly easy-to-implement design of the sensing element.

Furthermore, a sensor unit is provided which is arranged away from the gripper, in particular outside the contamination-intensive zone from the gripper to the cutting unit, and detects the position of the signal transmitter, in particular whether or not it is in the first, activated position.

In particular, this sensor unit can interact contactlessly with the signal transmitter, for example be optically operatively connected to it.

This makes it possible to arrange the sensor unit, which is usually electrically operated, far away from the signal transmitter, for example at the side of the gripper facing away from the product caliber, in particular at the rear end of the feed unit.

Preferably, the sensor unit should in any case be located on a non-movable part of the slicing machine so that the cables leading to it are not subjected to constant bending.

From its mounting location, the sensor unit, which operates optically for example, can be aimed directly at the signal transmitter, whereby the mounting location should preferably be selected so that there is a free line of sight between the sensor unit and the signal transmitter in all operating states.

If the signal transmitter is in the first, activated position, in particular in the beam path of the optical sensor, this signals to the control system that a product caliber is present at the corresponding gripper and in particular is held by the corresponding gripper. If this signal is missing, this means that no product caliber is present on the gripper or is not held by it in particular.

This makes it clear to the control system and, with a corresponding display, also to the operator whether a product caliber is properly present at the gripper and, in the case of several grippers, on each gripper, in particular whether it is held or not.

Furthermore, the sensing element and/or the signal transmitter can also be in a defined second position when the gripper is not holding a product caliber. This increases the informative value of the device, because detecting a defined second position is more reliable than deducing the absence of a product caliber on the gripper from a first activated position that has not been assumed.

For this purpose, the signal transmitter and/or the button element is preferably preloaded into the second, deactivated position by means of a spring.

For this purpose, there may also be a second sensor that detects whether the signal transmitter is in the defined second, deactivated position.

Preferably, the signal transmitter is pivotably attached to the gripper carrying it, in particular to its base body.

The pivot axis can either run in the feed direction, whereby the signal transmitter can have two different rotational positions about this feed direction, of which only the activated one can be detected by the sensor device, and the other can be detected by a second sensor device, if necessary.

However, the signal transmitter can also be pivoted, in particular claped, about an axis lying transverse to the feed direction, about which it can be pivoted, for example, between a deactivated position lying primarily in the feed direction and an activated position standing transverse to the feed direction, in the transverse direction being located in the beam path or effective range of one of the sensor units.

As a rule, there are several grippers next to each other, since in a slicer several product calibers are usually arranged next to each other and can be pushed forward together and sliced at the same time, and there is one gripper per product caliber.

Preferably, the grippers are pushed forward by means of a common drive unit in order to keep the drive effort within limits. As a rule, therefore, all grippers are attached to a common gripper unit which can be moved along a gripper guide running in the feed direction.

In order to compensate for the different lengths of the calibers at the beginning of the slicing of a group of several product calibers lying next to each other in the slicer, which can hardly be avoided due to the manufacturing process, the individual grippers are designed to be movable or variable in length, in particular with respect to the common gripper unit, and are generally pretensioned in the feed direction by means of a clamping element to their maximum length or maximum distance from the gripper unit.

This makes it possible, for example, for the gripper unit to be moved forward for gripping the rear ends of all product calibers by one gripper each until the sensor unit reports the presence and holding of a product caliber at each gripper, which will be the case earlier at one gripper than at one of the other grippers due to the different lengths of the product calibers.

This eliminates the need for too tight tolerances on the lengths of the product calibers, which simplifies their manufacture.

In order to nevertheless be able to slice a product caliber correctly in accordance with the feed of the gripper unit as soon as it is contacted, gripped and held by the gripper, this ability to change in length or move is preferably blocked, in particular friction-locked, for example by a blocking device, which can also be mechanically coupled to the sensing element.

As a result, as soon as the gripper has gripped the product caliber, it behaves like a gripper that is firmly connected to the gripper unit in the longitudinal direction, so that as soon as all product calibers have been gripped, all product calibers are pushed forward synchronously by the gripper unit and sliced.

BRIEF DESCRIPTION OF THE DRAWINGS

Embodiments according to the invention are described in more detail below by way of example.

DETAILED DESCRIPTION

Figure 1A:
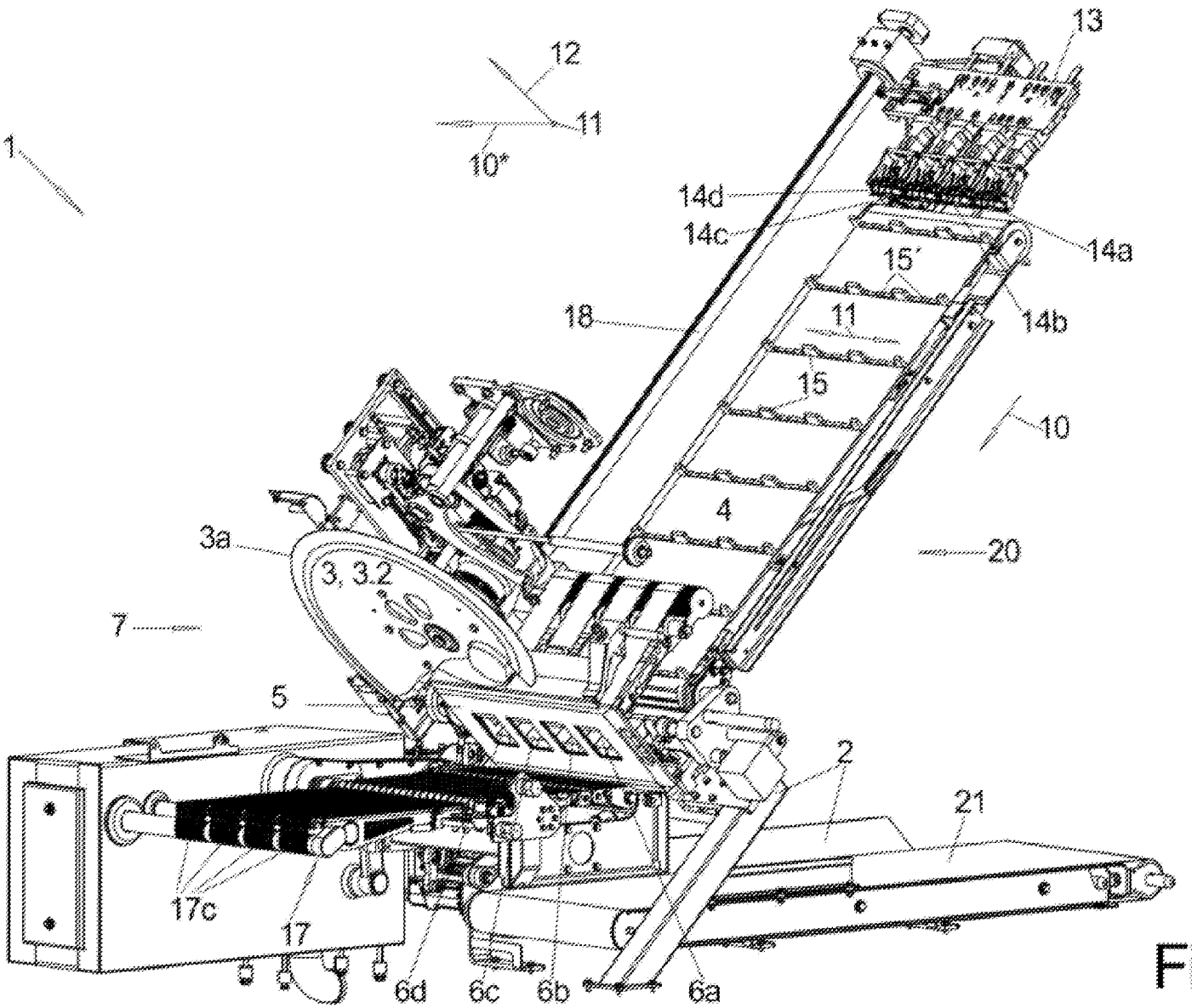
FIGS. 1*a, b*: a slicing machine in the form of a slicer according to the prior art in different perspective views.
Figure 1B:
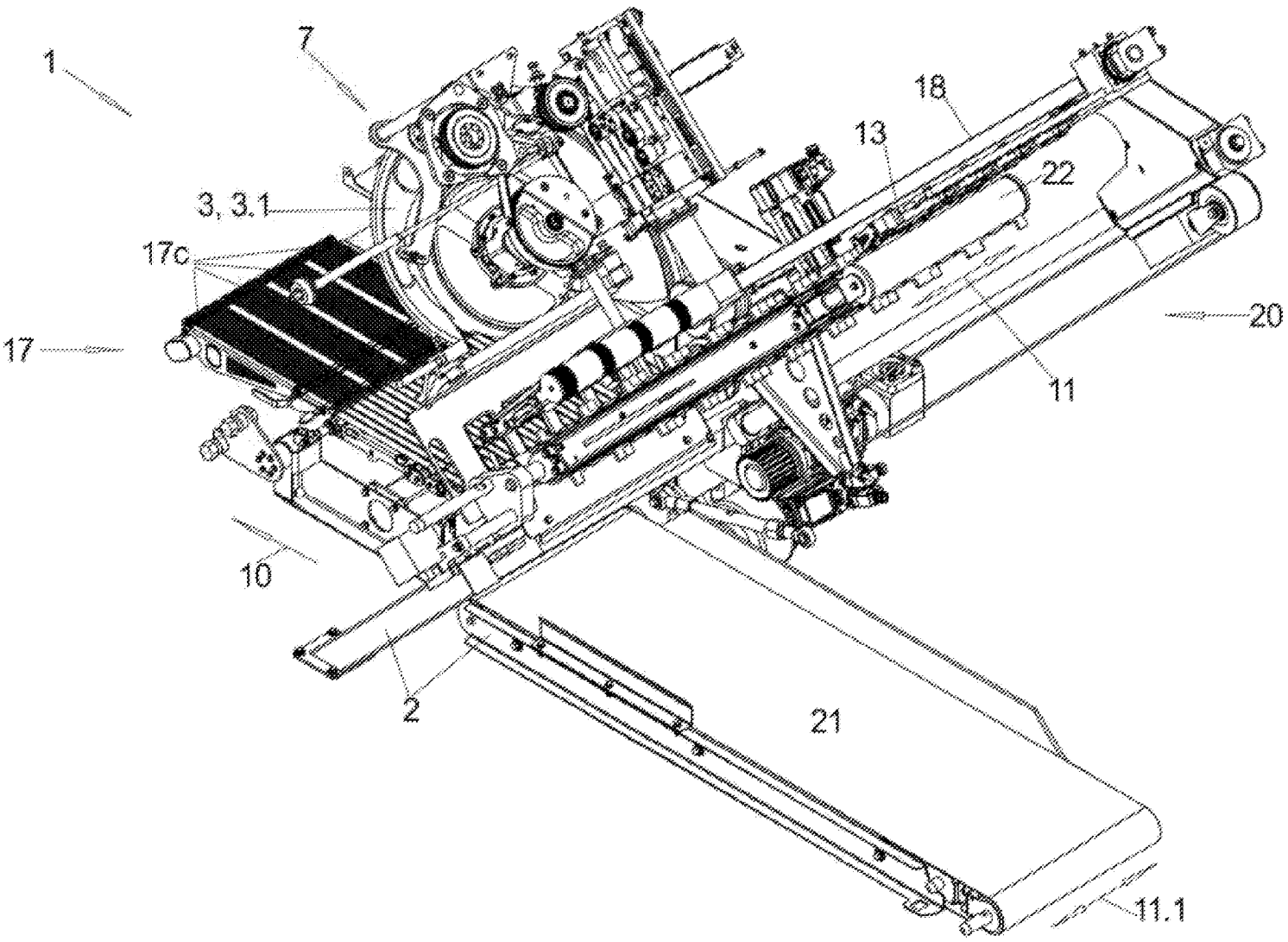
FIG. 1*c*: the slicing machine of FIGS. 1*a, b* in side view.
FIG. 1*d*: a simplified vertical longitudinal section through the slicing machine of FIGS. 1*a-c*, i.e., in the same viewing direction as FIG. 1*c*, in which the various conveyor belts can be seen more clearly because the cover and casing parts in front of them in the viewing direction lie in front of the section plane.
Figure 1C:
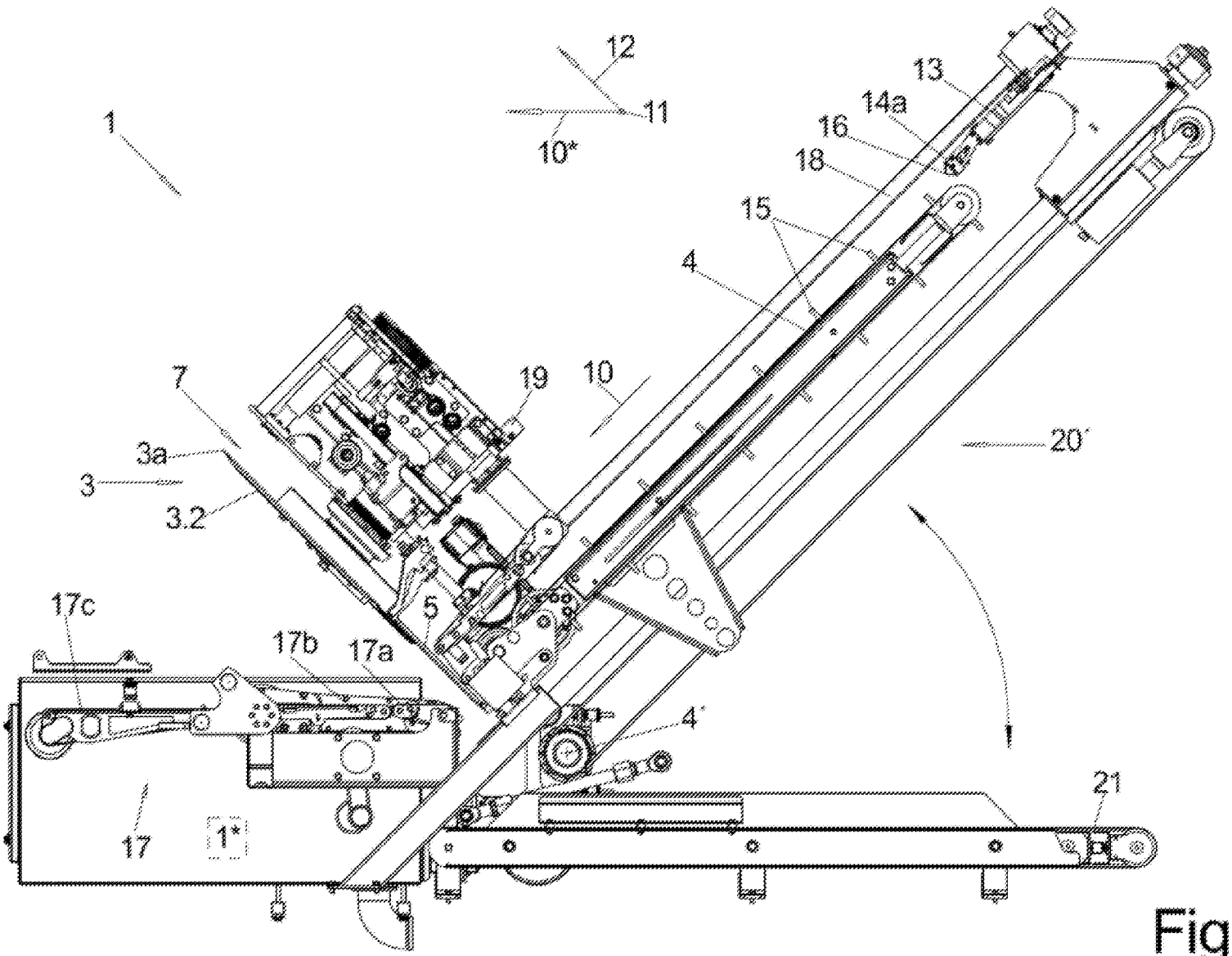

FIGS. 1*a*, 1*b* show different perspective views of a slicer 1 for simultaneously slicing several product calibers K side by side and depositing them in shingled portions P, each consisting of several slices S, with a general direction of travel 10* through the slicer 1 from right to left, and FIG. 1*c* shows a side view of this slicer 1.

Figure 1D:
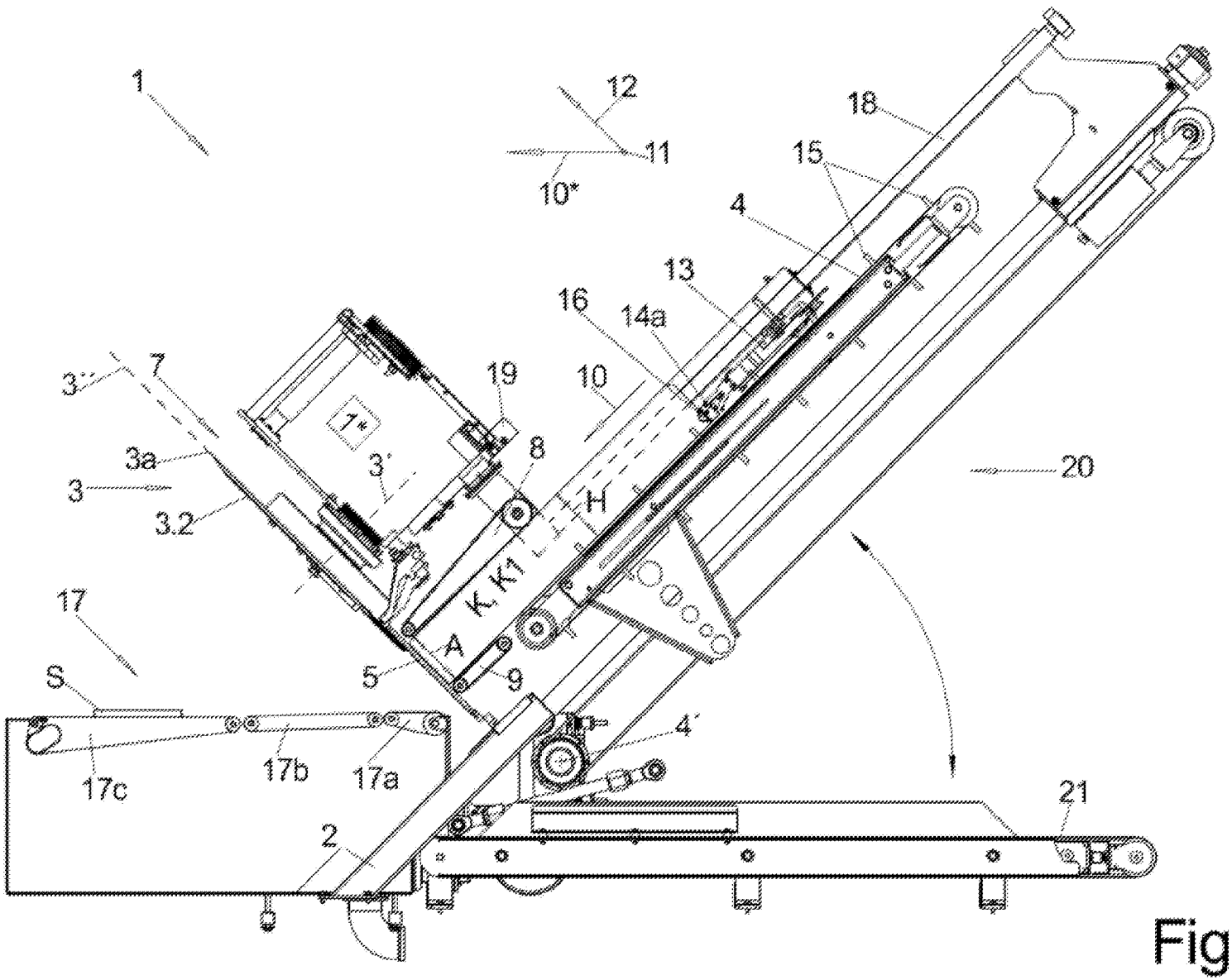

FIG. 1*d* shows a vertical section through such a slicer 1—simplified by omitting details less important for the invention—in longitudinal direction 10, the feed direction of the calibers K to the cutting unit 7 during cutting and thus the longitudinal direction of the calibers K lying in the slicer 1, i.e., with the same viewing direction as FIG. 1*c*.

It can be seen that the basic structure of a slicer 1 according to the prior art is that a cutting unit 7 with a rotating sickle blade 3 is fed with several, in this case four, product calibers K lying next to each other transversely to the feed direction 10 by a feed unit 20, from the front ends of each of which the rotating sickle blade 3 simultaneously cuts a slice S off.

For this purpose, the feed unit 20 comprises a feed conveyor 4 in the form of an endless, circulating feed belt 4, the upper run of which can be driven at least in the feed direction 10 and also in the opposite direction thereto, the calibers K lying next to one another in the width of this feed conveyor 4 resting on the feed belt 4 itself or on crossbars 15 which run over the width of the feed conveyor 4 and are arranged in or on the feed belt 4 at a distance from one another in the feed direction 10 and whose upper sides may constitute the bearing surface 15' for the individual calibers K.

The upper sides of the crossbars 15 have elevations aligned with one another with recesses between them for one of the calibers K to be placed on each, in this case four, to ensure adequate lateral guidance.

The calibers K can also rest directly on the top of the conveyor 4, in that elevations project upward from this top as a lateral guide for the calibers, without the presence of the crossbars 15 or, in any case, without projecting above the top of the feeder 4.

There may be a height sensor 19 which measures the height, i.e., thickness, of the individual product caliber K in the second transverse direction 12, i.e., perpendicular to the supporting surface of the conveyor 4, which is relevant for an automated control of the slicing and depositing process.

For slicing the product calibers K, the infeed conveyor 4 is in the inclined position shown in FIGS. 1*a-d*, with its cutting-side front end lying low and its rear end lying high, from which it can be folded down about a pivot axis 4' running in its width direction, the first transverse direction 11, which is located in the vicinity of the cutting unit 7, into an approximately horizontal loading position, in which it can then be driven in the general throughput direction 10* of the machine.

The rear end of a caliber K lying in the feed unit 20—see in FIG. 1*d* the first caliber K1 of the four calibers lying one behind the other in this viewing direction—is held form-fit by a gripper 14*a-d* in each case with the aid of gripper claws 16. These grippers 14*a*-14*d*, which can be activated and deactivated with respect to the position of the gripper claws 16, are attached to a common gripper unit 13, which can be tracked along a rod-shaped gripper guide 18 in the feed direction 10.

In this case, both the feed of the gripper unit 13 and/or the feed conveyor 4 can be driven in a controlled manner, but the specific feed speed of the calibers K is effected by a so-called upper and lower product guide 8, 9, which engage the upper and lower sides of the calibers K to be sliced at their front end regions near the cutting unit 7:

For cutting, the front ends of the calibers K are each guided through a so-called eyeglass opening 6*a-d* provided for each caliber, which are formed in a plate-shaped cutting frame 5, which is a component of the cutting unit 7, in that the cutting plane 3" runs directly in front of the front, obliquely downward-pointing end face of the cutting frame 5, in which the sickle blade 3 rotates with its cutting edge 3*a* and thus cuts off the projection of the calibers K from the cutting frame 5 as a slice S. The cutting plane 3" runs perpendicularly to the upper run of the feeder 4 and/or is spanned by the two transverse directions 11, 12, which are perpendicular to each other as well as to the feed direction 10. The cutting plane 3" runs perpendicular to the upper run of the feed conveyor 4 and/or is spanned by the two transverse directions 11, 12 which are perpendicular to each other and to the feed direction 10.

In this case, the inner circumference of the kaliber openings 6*a-d* of the cutting edge 3*a* of the blade 3 serves as a counter cutting edge.

Although the kaliber openings 6*a-d* of the replaceable cutting frame 5 are approximately adapted to the cross-sectional shape and size of the calibers K to be sliced, since their cross-sectional size is subject to variations in production technology, the cross-section of the kaliber openings 6*a-d* is generally somewhat larger than the cross-section of the caliber K to be sliced.

In order to nevertheless achieve a good cutting result and to be able to control parameters such as the contact force of the caliber K on the inner circumferential surface of the kaliber apertures 6*a-d* and other parameters, the lower and upper product guides 8, 9, each in the form of a conveyor belt, are provided, of which the lower product guide 9 with its upper run and the upper product guide 8 with the lower run of the corresponding conveyor belt are in frictional contact with the underside and upper side of the caliber K respectively.

Since both product guides 8, 9 can be driven in a controlled manner, in particular independently of each other, they determine the—continuous or clocked—feed speed of the calibers K through the cutting frame 5. Preferably, the two product guides 8, 9 are present and controllable separately for each caliber K in the first transverse direction 11.

In addition, at least the upper product guide 8 is displaceable in the second transverse direction 12—which runs perpendicular to the surface of the upper run of the feed conveyor 4 claped up into the cutting position—for adaptation to the height H of the caliber K in this direction. Furthermore, at least one of the product guides 8, 9 can be construed to be pivotable about one of its pulleys in order to be able to change the direction of the run of its conveyor belt resting against the caliber K to a limited extent.

The slices S, which stand at an angle in space according to the inclined position of the feed unit 20 and cutting unit 7 during separation, fall onto a discharge unit 17, which starts below the cutting frame 5 and runs in the throughput direction 10*, and which in this case consists of several discharge conveyors 17*a, b, c,* which are arranged one behind the other with their upper runs approximately aligned in the throughput direction 10*, one of which can also be embodied as a weighing unit.

Below the infeed unit 20 there is also an approximately horizontal end piece conveyor 21, also in the form of an endlessly circulating conveyor belt, which starts with its front end below the cutting frame 5 and directly below or behind the discharge unit 17 and with its upper run transports the residues falling on it from there to the rear against the direction of travel 10*.

For this purpose, at least the first discharge conveyor 17*a* in the throughput direction 10* can be driven with its upper run in the opposite direction to the throughput direction 10*, so that a residual piece falling on it, for example, can be transported to the rear and fall onto the lower end piece conveyor 21.

After separation, the slices S fall either directly onto these discharge conveyors 17*a-c*, as shown in FIG. 1*d*, or onto a packaging element resting on it, such as a carrier carton or a flat plastic tray.

A control 1* controls the entire slicer, in particular the movements of all moving parts of slicer 1.

Figure 3A:
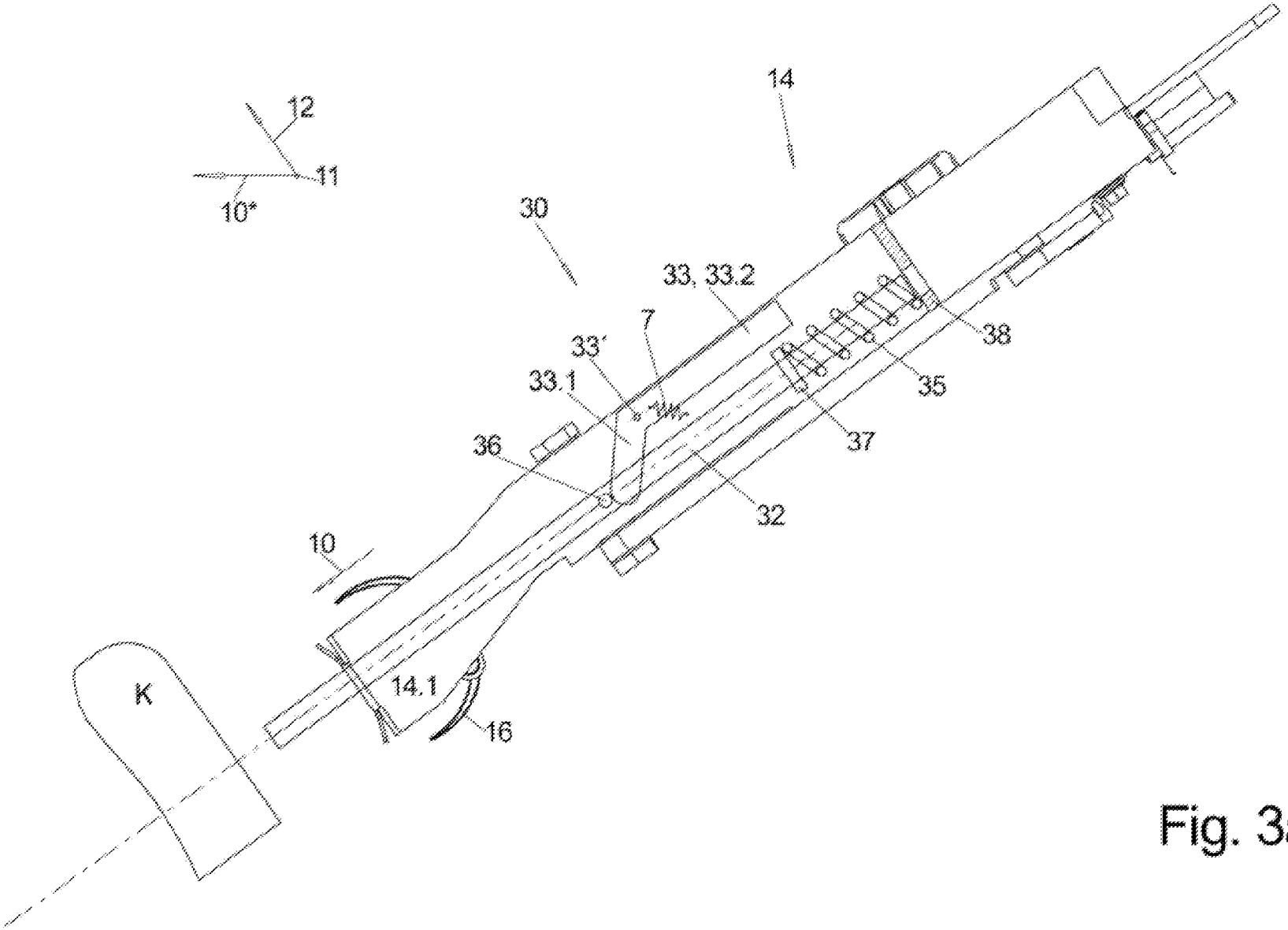
FIG. 3*a*: a side view of the gripper without the product caliber on it and with the gripper claws open.
Figure 3B:
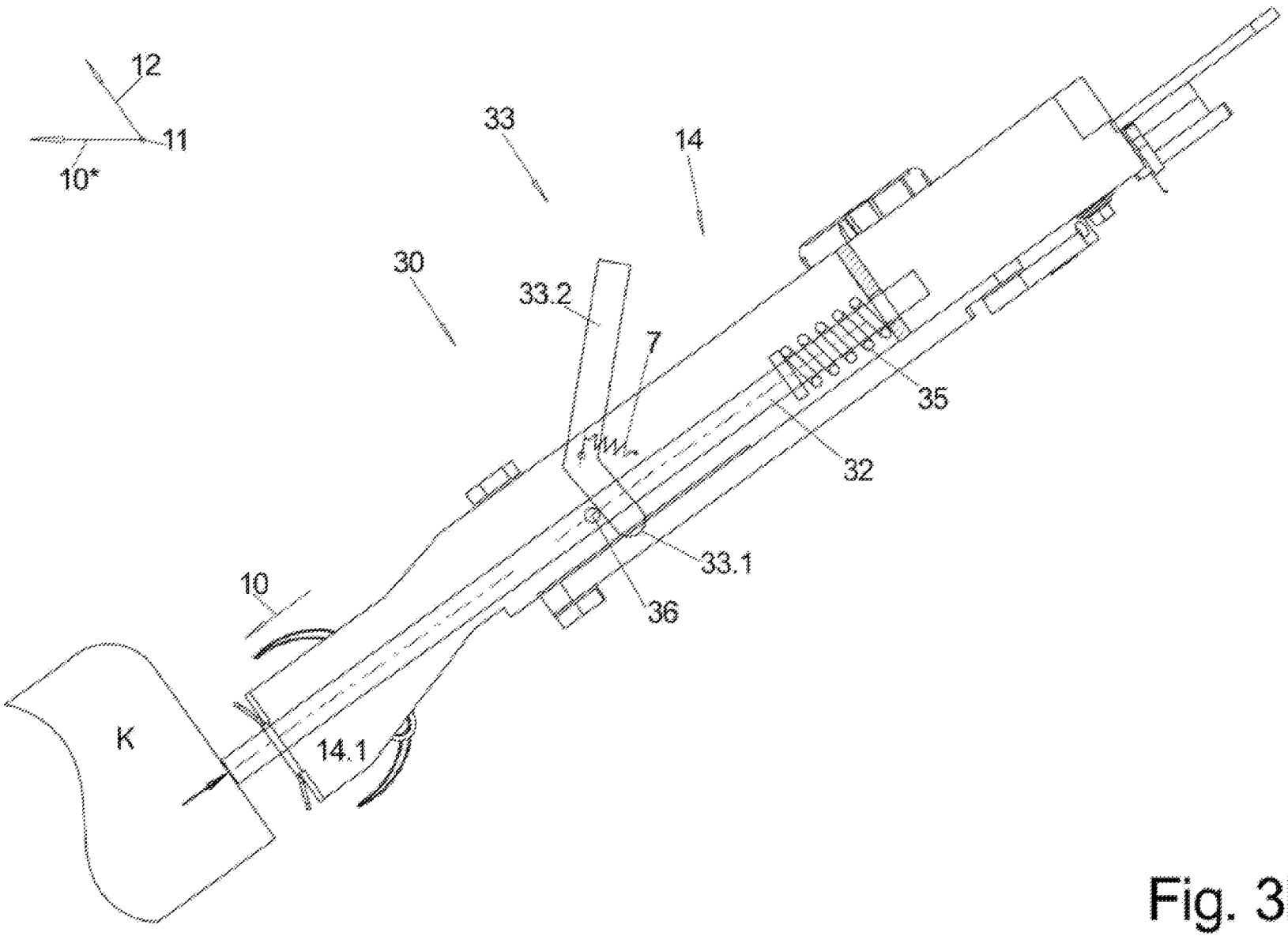
FIG. 3*b*: the gripper with contacting product caliber, with deactivated gripper claws, in side view.
Figure 3C:
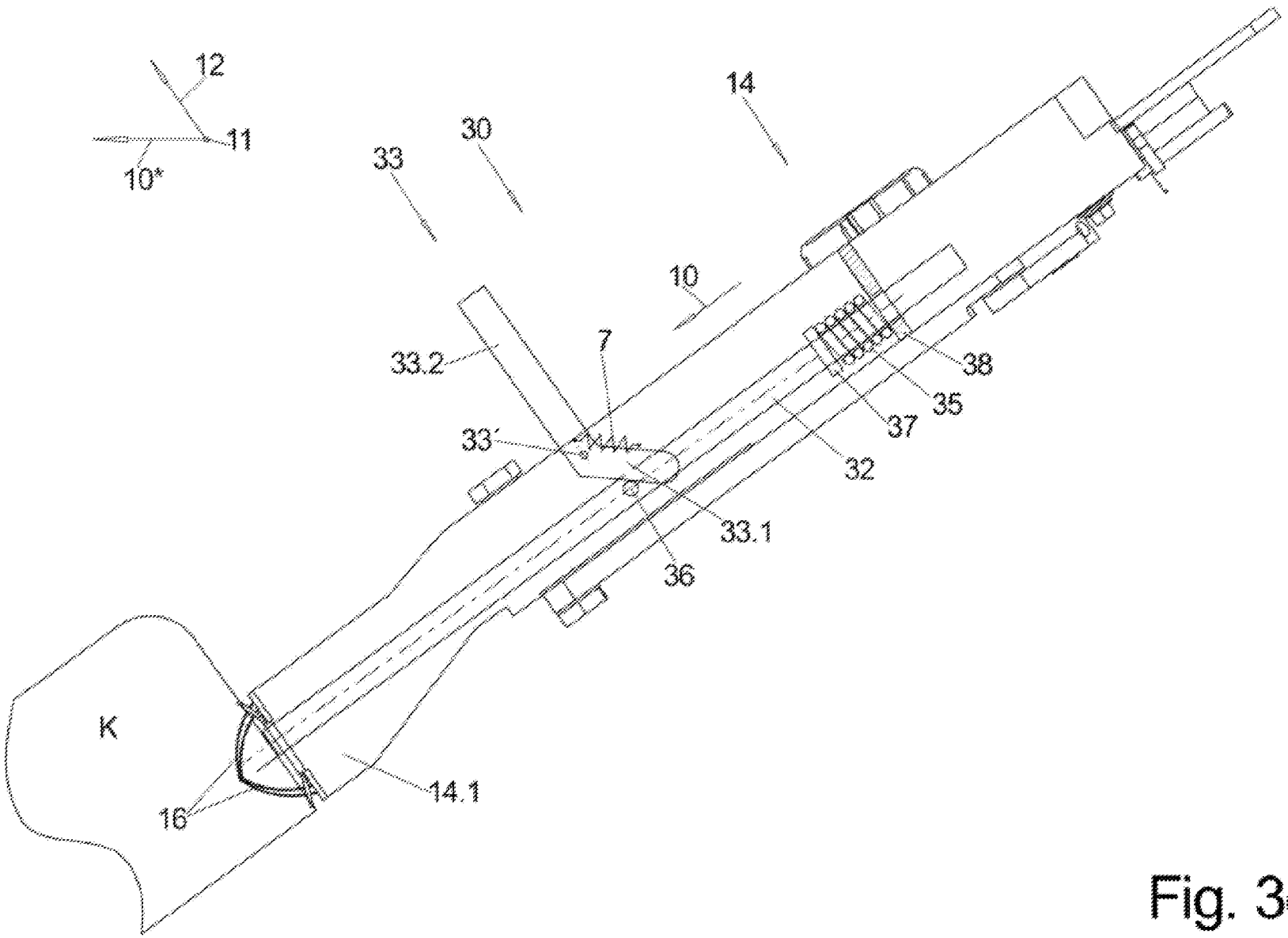
FIG. 3*c*: a side view of the gripper with contacting product caliber and with activated gripper claws.

FIGS. 3*a-c* show the function of the product detection device 30 on an enlarged gripper 14 with gripper elements in the form of gripper claws 16 that can be retracted into the product caliber K:

At the front end of the base body 14.1 of the gripper 14, a gripper pinion 32 extending in particular in the feed direction 10 can be extended from the base body 14.1 in the feed direction 10 as a sensing element, which is pretensioned in the extended position, its rest position, relative to the base body 14.1 by a spring 35 as a tensioning element.

The spring 35 is supported, on the one hand, on a shoulder 37 of the pinion 32 and, on the other hand, on a stop plate 38, which is mounted stationary in the base body 14.1 and has a passage for the rear end of the pinion 32 to pass through.

If, as shown in FIG. 3*a*, the gripper 14 approaches the rear end face of a product caliber K with the gripper pinion 32 extended forwards, then from the point of contact the caliber K presses the pinion 32 into the base body 14.1 against the force of the tension element 35 into an activated position, corresponding to the transition from FIG. 3*a* to FIG. 3*b*.

When the distance between the product caliber K and the base body 14.1 of the gripper 14 has reached or falls below a predetermined value, an extension 36, which projects from the gripper pinion 32 transversely to the path of movement of the latter, presses against a signal transmitter 33, in this case against the actuating arm 33.1 of a two-armed lever 33, which is mounted in the base body 14.1 about a pivot axis 33' in such a way that, according to FIG. 3*b*, its signaling arm 33.2 is pivoted by the extension 36 from the rest position lying flat in or on the base body 14.1 into an activated position projecting transversely thereto, in this case projecting upwards and protruding from the base body 14.1, and this against the force of a spring 7 which otherwise holds the signal transmitter 33 in the rest position.

As the pinion 32 is pushed further into the base body 14.1, the signal transmitter 33 is pivoted further until it reaches an end position in which the pinion 32 is fully inserted, by which is meant a position in which the caliber K has reached the maximum position approaching the base body 14.1 and in particular resting against it.

In this end position, according to FIG. 3*c*, the signal arm 33.2 projects at right angles to the feed direction 10 in this side view, while FIG. 3*b* shows an intermediate position at about 45° to the feed direction 10, and the signal arm 33.2 projects less far from the base body 14.1 in the second transverse direction 12 than in the end position of FIG. 3*c*.

Figure 2:
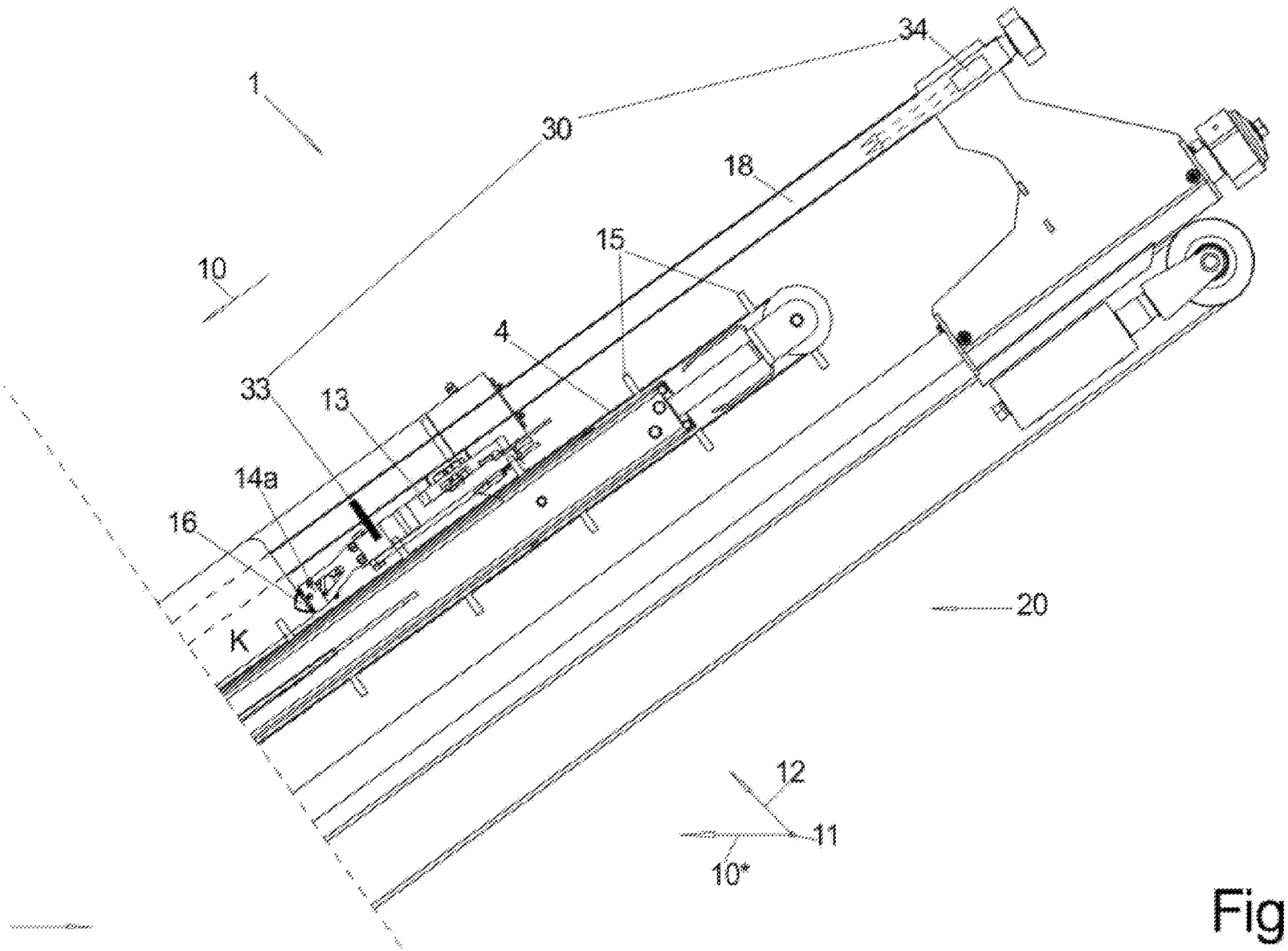
FIG. 2: a part of the feeding unit of the slicer in an enlarged view compared to the side view of FIG. 1*d*, with a product detection device.

The activated signal transmitter 33, in particular signal arm 33.2, projecting from the base body 14.1 in a direction transverse to the feed direction 10 can be detected by the sensor 34 at the rear end of the feed unit 20 (cf. FIG. 2) from a defined first activated position, for example the intermediate position of FIG. 3*b*, and transmits the signal to the control 1* that the product caliber K is located closely adjacent to the end face of the base body 14.1 of the gripper 14, so that in particular the gripper claws 16 can penetrate into the rear end of the product caliber K during extension, i.e., activation, and hold it.

Since the gripper claws 16 are preferably also activated exclusively mechanically, they can be activated—which is not shown—by the same gripper plunger 32 that also activates the signal transmitter 33, preferably even before the gripper pinion 32 has reached its end position and the product caliber K is in contact with the front of the base body 14.1.

For example, on its travel path between an intermediate position, the first activated position, with the pinion 32 already partially depressed, approximately as shown in FIG. 3*b*, and a second activated position, approximately the end position shown in FIG. 3*c*, the pinion 32 can additionally pivot the gripper claws 16 by means of mechanical coupling from the deactivated position shown in FIG. 3*b*, which is still retracted, to the activated position shown in FIG. 3*c*, in which the gripper claws 16 are extended into the caliber K.

Only when the signal arm 33.2 is swung out completely, in particular perpendicular to the feed direction 10, does it mean that the caliber K is also held by the gripper 14.

Preferably, the first activated position and the second activated position are detected in a distinguishable manner, either by two different sensors of the sensor unit 34 or by the fact that one and the same sensor can distinguish the two activated positions of the signal arm 33.2 protruding by different distances.

If both facts are to be indicated only in sum by the signal transmitter 33, there must be a further, preferably mechanical, connection between the gripper claws 16 and the signal transmitter 33, which is designed in such a way that the signal transmitter 33 is activated only when both the gripper plunger 32, which indicates the approach of the product caliber K, is in the activated position and the gripper claws 16.

In the present design, this can be achieved by arranging the extension 36 at a more forward longitudinal position of the pinion 32, which pivots the signal transmitter 33 only after the pinion has already activated the gripper claws 16.

However, the gripper claws 16 can also be activated in other ways than by the button element, in particular the pinion 32, which moves the signal generator 33.

Then, an activated signal generator 33 only means the information that the product caliber K is in a grippable, closely adjacent position to the base body 14.1, but not necessarily that the gripper claws 16 are also extended into the product caliber K and hold it.

Then, a second signal transmitter may be present, which is mechanically coupled to the drive mechanism of the gripper claws 16, for example, and must be detected separately with respect to its position in order to obtain information about the position of the gripper claws 16.

In particular, the gripper claws 16 of a gripper may be moved from the deactivated to the activated position by a pneumatic cylinder and the sensing element 32 may be mechanically coupled to the valve for supplying compressed air to this pneumatic cylinder so that an activated sensing element activates the gripper claws 16.

LIST OF REFERENCE SIGNS

1 slicer
1* control
2 base frame
3 blade
3*a* cutting edge
3" blade plane, cutting plane
4 feed conveyor
4' feed direction
5 cutting frame
6*a-d* product opening
7 cutting unit
8 upper product guide, upper guide belt
8*a* cutting frame-side pulley
8*b* cutting frame-averted pulley
9 lower product guide, lower guide belt

9*a* cutting frame-side pulley
9*b* cutting frame-averted pulley
10 feed direction, longitudinal direction, axial direction
11 1. transverse direction
12 2. transverse direction (roughly: plunging direction of blade)
13 gripper slide
14.14*a-d* gripper
14.1 basic body
15 crossbar
16 gripper claw
17 discharge unit
17*a, b, c* portioning belt, discharge conveyor
18 gripper guide
19 height sensor
20 supply unit
21 end piece conveyor
30 product detection device
31 spring
32 sensing element, gripper pinion, plunger
33 signal transmitter
34 sensor unit
35 tension element, spring
36 process
37 shoulder
38 stop plate
H product height
K product, product caliber
S slice
P portion

The invention claimed is:

1. A slicing machine for slicing a product caliber, comprising:
a cutting unit,
a feed unit for feeding the product caliber to the cutting unit in a feeding direction,
a gripper, which is movable along the feed direction and is movable
between an engagement position in which it holds the product caliber, and
a release position in which it does not hold the product caliber,
a controller for controlling moving parts of the slicing machine, and
a product detection device connected to the controller and configured to detect whether or not the gripper is holding a product caliber,
wherein the product detection device includes
a sensing element movably disposed on the gripper so as to be movable from a normal position to an activated position by one end of the product caliber,
a signal transmitter which is pivotably attached to the gripper and operatively connected to the sensing element in such a way that it is in an activated position when the end of the product caliber is at least in contact with the sensing element and is otherwise in a rest position, and
a sensor unit arranged away from the gripper and adapted to detect whether or not the signal transmitter is in the activated position.

2. The slicing machine according to claim 1, wherein
the sensor unit is arranged behind the gripper in the feed direction, and/or
the sensor unit is arranged at a non-moving part of the slicing machine.

3. The slicing machine according to claim 1, wherein the sensor unit is embodied to detect whether the signal transmitter is in the rest position.

4. The slicing machine according to claim 1, wherein
the signal transmitter is biased toward the rest position, and/or
the sensing element protrudes from the gripper in the normal position and is biased into the normal position.

5. The slicing machine according to claim 4, further comprising a spring that biases the signal transmitter toward the rest position.

6. The slicing machine according to claim 1, wherein the sensor unit comprises a contactless sensor.

7. The slicing machine according to claim 6, wherein the contactless sensor comprises an optical sensor.

8. The slicing machine according to claim 7, wherein the optical sensor comprises a laser and/or a camera.

9. The slicing machine according to claim 1, comprising a plurality of the grippers.

10. The slicing machine according to claim 9, wherein the plurality of the grippers are variable in length in the feed direction, so that a length of each gripper can be varied.

11. The slicing machine according to claim 10, wherein each gripper has a blocking device which is configured to block a length change after the sensing element to which the gripper is mechanically coupled is in contact with a product caliber.

12. The slicing machine according to claim 10, wherein the grippers are pretensioned in the feed direction by a clamping element.

13. The slicing machine according to claim 9, further comprising a drive unit to move the grippers in the feed direction, wherein the grippers are arranged at a common gripper unit that can be moved by the drive unit.

14. The slicing machine according to claim 13, wherein the common gripper unit comprises a gripper carriage.

15. The slicing machine according to claim 1, wherein the signal transmitter is mechanically coupled to the sensing element.

16. A slicing machine for slicing a product caliber, comprising:
a cutting unit,
a feed unit for feeding the product caliber to the cutting unit in a feeding direction,
a gripper, which is movable along the feed direction and is movable
between an engagement position in which it holds the product caliber, and
a release position in which it does not hold the product caliber,
a controller for controlling moving parts of the slicing machine, and
a product detection device connected to the controller and configured to detect whether or not the gripper is holding a product caliber,
wherein the product detection device includes
a sensing element movably disposed on the gripper so as to be movable from a normal position to an activated position by one end of the product caliber,
a signal transmitter which is operatively connected to the sensing element in such a way that it is in an activated position when the end of the product caliber is at least in contact with the sensing element and is otherwise in a rest position, and
a sensor unit arranged away from the gripper and adapted to detect whether or not the signal transmitter is in the activated position, and wherein the slicing machine further comprises a spring that biases the signal transmitter toward the rest position.

17. The slicing machine according to claim 16, wherein the sensing element protrudes from the gripper in the normal position and is biased into the normal position.

18. A slicing machine for slicing a product caliber, comprising:

a cutting unit, a feed unit for feeding the product caliber to the cutting unit in a feeding direction, a gripper, which is movable along the feed direction and is movable between an engagement position in which it holds the product caliber, and a release position in which it does not hold the product caliber, a controller for controlling moving parts of the slicing machine, and a product detection device connected to the controller and configured to detect whether or not the gripper is holding a product caliber, wherein the product detection device includes a sensing element movably disposed on the gripper so as to be movable from a normal position to an activated position by one end of the product caliber, a signal transmitter which is operatively connected to the sensing element in such a way that it is in an activated position when the end of the product caliber is at least in contact with the sensing element and is otherwise in a rest position, and a sensor unit arranged away from the gripper and adapted to detect whether or not the signal transmitter is in the activated position, wherein the sensor unit comprises a contactless optical sensor.

19. The slicing machine according to claim 18, wherein the optical sensor comprises a laser and/or a camera.

20. The slicing machine according to claim 18, comprising a plurality of the grippers, wherein the grippers are pretensioned in the feed direction by a clamping element.

* * * * *